US005381676A

United States Patent [19]

Shibata et al.

[11] Patent Number: 5,381,676

[45] Date of Patent: Jan. 17, 1995

[54] FABRIC TAKE-UP MECHANISM FOR CIRCULAR KNITTING MACHINES

[75] Inventors: Takao Shibata, Takatsuki; Kozo Taniguchi; Tashio Noguchi, both of Kobe; Koji Tsuchiya, Nishinomiya, all of Japan

[73] Assignee: Precision Fukuhara Works, Ltd., Japan

[21] Appl. No.: 128,807

[22] Filed: Sep. 29, 1993

[30] Foreign Application Priority Data

Oct. 9, 1992 [JP] Japan ..... 4-297978
Dec. 7, 1992 [JP] Japan ..... 4-351754

[51] Int. Cl.[6] ..... D04B 15/88
[52] U.S. Cl. ..... 66/149 R; 66/152
[58] Field of Search ..... 66/149 R, 151, 152

[56] References Cited

U.S. PATENT DOCUMENTS

| | | | |
|---|---|---|---|
| 3,842,627 | 10/1974 | Bassist | 66/151 |
| 4,027,506 | 6/1977 | Bitzer | 66/149 R |
| 4,233,825 | 11/1980 | Glaspie | 66/149 R |
| 4,236,390 | 12/1980 | Blank et al. | 66/149 R |
| 4,671,083 | 6/1987 | Sawazaki et al. | 66/151 |
| 4,790,152 | 12/1988 | Geitner | 66/149 R |
| 4,969,340 | 11/1990 | Brega | 66/149 R |
| 5,133,197 | 7/1992 | Shima et al. | 66/149 R |
| 5,179,846 | 1/1993 | Lin | 66/149 R |

FOREIGN PATENT DOCUMENTS

| | | | |
|---|---|---|---|
| 0148727 | 7/1985 | European Pat. Off. . | |
| 237493 | 9/1987 | European Pat. Off. | 66/149 R |
| 0261049 | 3/1988 | European Pat. Off. . | |
| 2631223 | 1/1978 | Germany | 66/149 R |
| 4289251 | 10/1992 | Japan | 66/149 R |
| 2246369 | 1/1992 | United Kingdom . | |

*Primary Examiner*—Clifford D. Crowder
*Assistant Examiner*—John J. Calvert
*Attorney, Agent, or Firm*—Bell, Seltzer, Park & Gibson

[57] ABSTRACT

A fabric take-up apparatus for a circular knitting machine includes a set of delivery rolls for flattening and delivering the flattened fabric to take-up means which winds the flattened fabric into a roll, sensing means for sensing the tension in the fabric and for generating electrical signals indicative of fluctuations in tension from a predetermined, desired tension in the fabric, variable speed drive means for driving the delivery rolls, and control means for controlling the variable speed drive means responsive to the electrical signals generated by the tension sensing means.

9 Claims, 8 Drawing Sheets

FABRIC TAKE-UP MECHANISM FOR CIRCULAR KNITTING MACHINES

FIELD OF THE INVENTION

This invention relates to circular knitting machines and more particularly to a fabric take-up mechanism for such circular knitting machines.

BACKGROUND OF THE INVENTION

Circular knitting machines have rotating cylinders and knitting instrumentalities which produce a tubular fabric which rotates with the cylinder. It is known to withdraw the fabric being formed downwardly through the rotating cylinder by a fabric take-up mechanism which flattens the tubular fabric and winds the flattened fabric around a take-up roll. In such circular knitting machines, the take-up mechanism rotates synchronously with the cylinder to avoid twisting of the fabric as it rotates with the needle cylinder.

Conventionally, the take-up speed of the take-up mechanism of the circular knitting machine is adjusted while the machine is not in operation to a preset value calculated to maintain the fabric under tension when the knitting machine knits the maximum length of fabric it is capable of producing for that type of fabric. However, if the length of fabric being knitted varies from this maximum length because of different stitch construction, different types of yarn, or variation in the stitch lengths being formed, tension in the fabric will gradually increase during knitting to the point that the fabric is torn or knitting needles are placed under sufficient stress that breakage occurs. Previous attempts to solve this problem have either failed or have been only partially successful.

One such prior attempt provides a detector for detecting substantial increases in tension in the fabric and a stop motion to stop the knitting machine when such tension exceeds a predetermined maximum allowable value. While avoiding torn fabric or breakage of needles, such an attempt resulted in substantial downtime for knitting machines and reduced production, as well as substantial operator time in making manual adjustments of the take-up speed of the knitting machines.

Another suggested solution to the problem disclosed in the U.S. Pat. No. 4,671,083, owned by the same assignee as is this application. In this patent, a variable speed drive is disclosed involving a belt and variable pulleys which respond somewhat to the tension in the fabric to vary the speed of the take-up mechanism to reduce the tension in the fabric due to belt slippage in the pulleys. The drive mechanism for the take-up unit disclosed in U.S. Pat. No. 4,671,083 has been partially successful in addressing the problem but still requires substantial operator adjustment of the drive mechanism and only partially responds to increases and decreases in tension in the knitted fabric.

SUMMARY OF THE INVENTION

With the foregoing in mind, it is an object of the present invention to provide a take-up mechanism for a circular knitting machine which senses variations in tension within the fabric being produced on the circular knitting machine and varies the take-up speed in response to such sensed variations in tension to maintain a substantially constant tension in the fabric.

This object of the invention is accomplished by providing a take-up mechanism including a plurality of the fabric delivery rolls which receive the fabric from the circular knitting machine cylinder, flattens the fabric and feeds the fabric downwardly to a take-up roll which winds the flattened fabric thereabout to form a roll of fabric. The take-up mechanism of this invention includes tension sensing means for sensing variations above or below a preset tension value desired in the fabric being wound about the take-up roll and variable speed motor drive means connected to the sensing means and including control means for varying the speed of the motor drive for the delivery rolls responsive to the sensed variations in tension to maintain a substantially uniform desired tension in the fabric. The present invention also provides an improved drive apparatus for the take-up mechanism of a circular knitting machine.

In the drawings and specifications, there have been set forth preferred embodiments of the invention, and although specific terms are employed, they are used in a generic and descriptive sense only and not for purposes of limitation.

BRIEF DESCRIPTION OF THE DRAWINGS

Some of the objects and advantages of the present invention having been stated, others will appear as the description proceeds when considered in conjunction with the accompanying schematic drawings, in which.

DETAILED DESCRIPTION OF THE PREFERRED EMBODIMENTS

Figure 1:
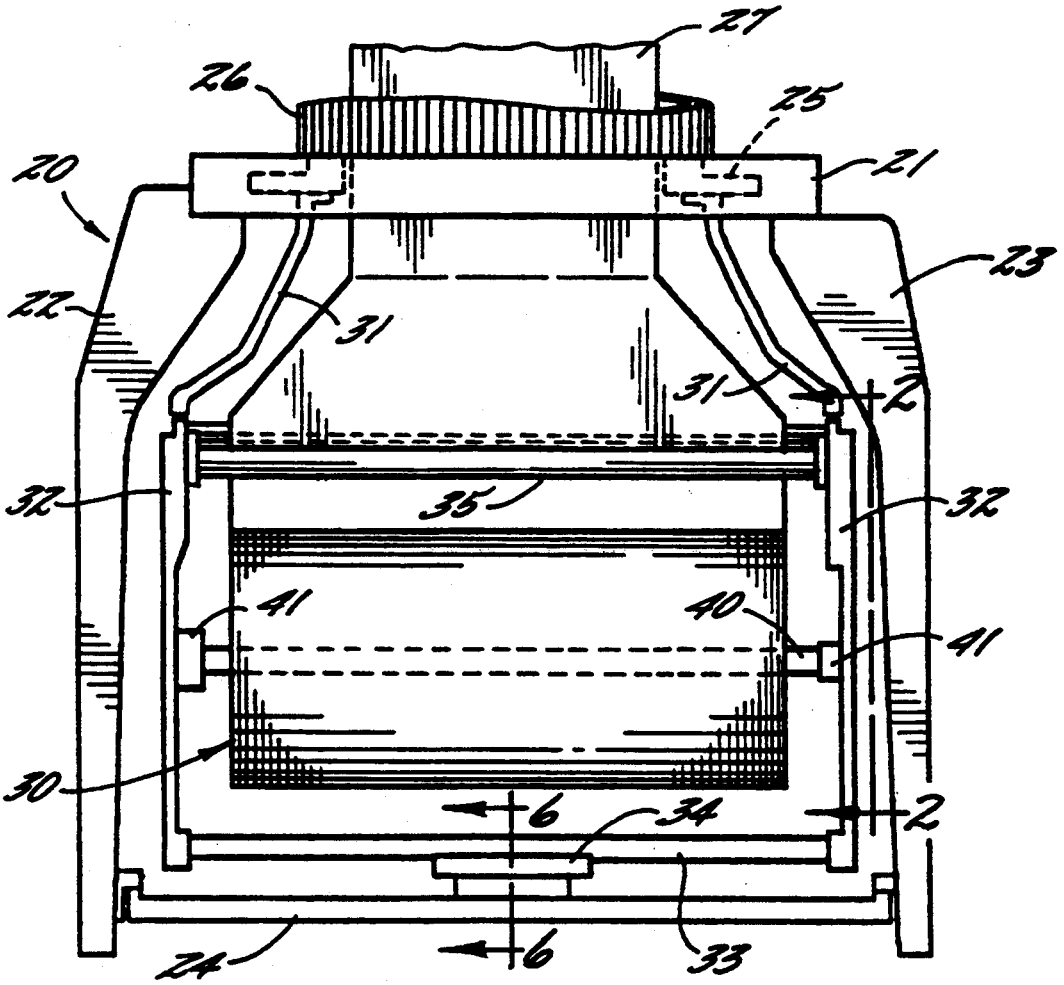
FIG. 1 is a fragmentary front elevational view of a circular knitting machine incorporating the features of the present invention.

Referring now more specifically to the drawings and particularly to FIG. 1, there is illustrated a circular knitting machine, generally indicated at 20, which includes a bed 21 supported by a plurality of legs 22 and 23 connected near their lower ends by a base frame member 24. The bed 21 supports a ring gear 25 for drivingly rotating a needle cylinder 26 rotatably mounted on bed 21. Knitting machine 20 includes knitting instrumentalities (not shown) which produce a seamless tubular knit fabric 27 which depends downwardly through the cylinder 26.

A fabric take-up mechanism is generally indicated at 30 and includes a supporting framework which mounts the take-up mechanism 30 from ring gear 25 and base member 24 for rotation synchronously with the cylinder 26. This framework includes brackets 31 suspended from ring gear 25 and depending downwardly and outwardly therefrom. A pair of side frame members 32 are mounted at their upper ends on brackets 31 and depend downwardly therefrom and are connected together at their lower ends by a bottom frame member 33. Bottom frame member 33 is rotatably mounted on base member 24 by a bearing box 34. The supporting structure for the take-up mechanism 30 is more particularly shown and described in U.S. Pat. No. 4,671,083 issued Jun. 9, 1987, which disclosure is incorporated herein by reference.

Take-up mechanism 30 further includes a set of fabric delivery rolls, which as illustrated is a set of three rolls 35, 36 and 37 arranged generally in the same horizontal plane and which co-act together to form nips therebetween through which the fabric 27 is threaded. Preferably, fabric 27 passes through the nip between rolls 36 and 37, around the bottom of roll 36 and upwardly through the nip between rolls 35 and 36 and thence around the top and outside of roll 35 and downwardly therefrom to a take-up roll 40. Take-up roll 40 is journaled for free rotation in bearings 41 at opposite ends thereof mounted on the side frame members 32. Take-up roll 40 is contacted and driven in rotation by a driving roll 42 journaled for rotation at its opposite ends in bearings carried by mounting members 43. Mounting members 43 are pivotally mounted at their ends opposite driving roll 42 by pivots 44 on brackets 45 which are, in turn, mounted on side frame members 32. Driving roll 42 is thus free to move upwardly and downwardly about pivots 44 while remaining in contact with the surface of take-up roll 40 or the fabric being wound about roll 40 to drive the roll 40 and the fabric roll being formed thereon by surface contact. Preferably, a pivotal motion inhibitor 46 is pivotally mounted to one of the driving roll mounting members 43 and to one of the brackets 45 to prevent rapid pivotal movement of the drive roll 42, as when a roll of fabric is removed from the take-up roll 40 and the drive roll 42 returns to the starting position.

Figure 3:
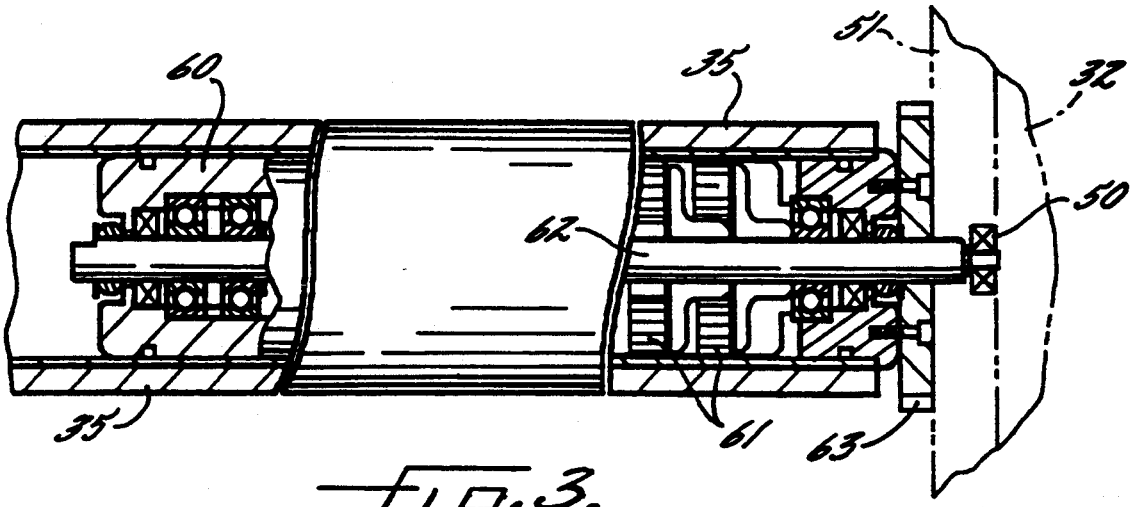
FIG. 3 is a fragmentary enlarged sectional view taken substantially along line 3—3 in FIG. 2.

Delivery roll 35 is journaled at its opposite ends in bearings 50 mounted on side frame members 32 (FIG. 3). Roll 35 has mounted thereon a pair of swing arms 51 which are journaled for pivotal movement about the axis of delivery roll 35. Swing arms 51 extend outwardly from roll 35 substantially horizontally and terminate in free ends. Swing arms 51 include longitudinal slots 52 extending horizontally therein and being open at the free ends of swing arms 51.

Delivery roll 36 is journaled at its opposite ends in bearings 53 which are square in outer configuration and are received in the slots 52 in swing arms 51. Accordingly, delivery roll 36 is mounted for rotation in bearings 53 while bearings 53 are held against rotation in slots 52 in swing arms 51. Similarly, delivery roll 37 is journaled at its opposite ends in square bearings 54 also received in slots 52 in swing arms 51. Delivery rolls 36 and 37 are spring biased into contact with each other and roll 36 into contact with roll 35 by compression springs 55 pressing against square bearings 54 at one end thereof and against end caps 56 on swing arms 51 at their other ends. Pressure relief mechanisms 57 are provided for relieving the pressure of springs 55 on the delivery rolls 36 and 37.

Figure 2:
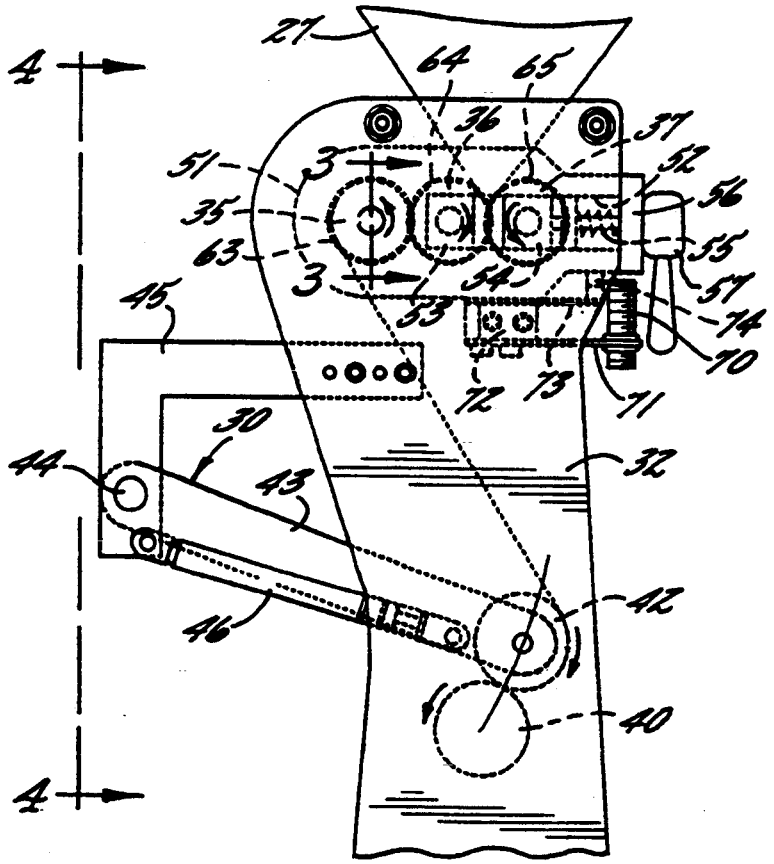
FIG. 2 is a fragmentary sectional view taken substantially along line 2—2 in FIG. 1.

In the embodiment illustrated in FIGS. 1 through 3, delivery rolls 35, 36 and 37 are driven by a drive means which includes a variable speed, out-rotor type DC motor 60, such as, a motor made by Itoh Electric, K. K. Motor 60 drives reduction gearing 61 which, in turn, drives delivery roll 35. Motor 60 and gearing 61 are housed within the hollow delivery roll 35 and are mounted on a stub shaft 62 which also mounts roll 35 for rotation.

A spur gear 63 is mounted on one end of delivery roll 35 for rotation therewith. Spur gear 63 meshes with a spur gear 64 mounted on one end of delivery roll 36 for rotating delivery roll 36 synchronously with delivery roll 35. Spur gear 64 meshes with a spur gear 65 drivingly mounted on one end of delivery roll 37. Accordingly, delivery rolls 35, 36 and 37 are driven in rotation by variable speed motor 60 through reduction gearing 61 and spur gears 63, 64 and 65.

Figure 4:
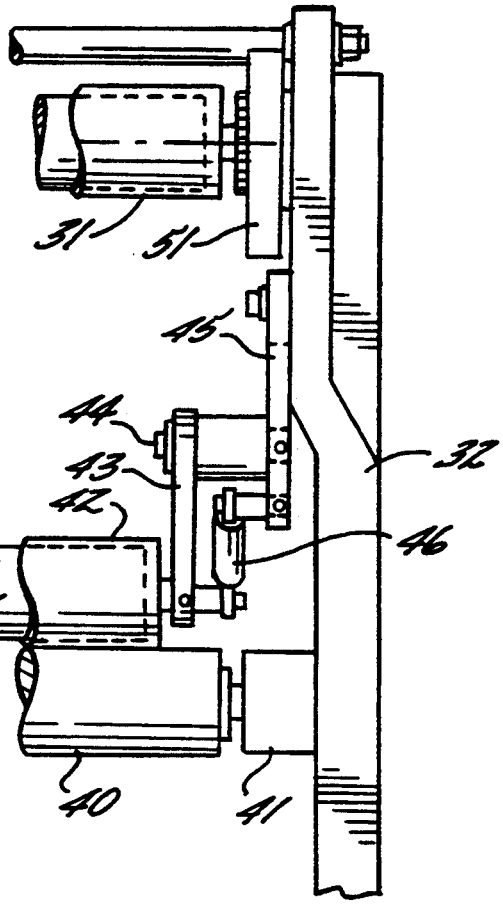
FIG. 4 is an enlarged fragmentary elevational view looking in the direction of the arrows 4—4 in FIG. 2.
Figure 5:
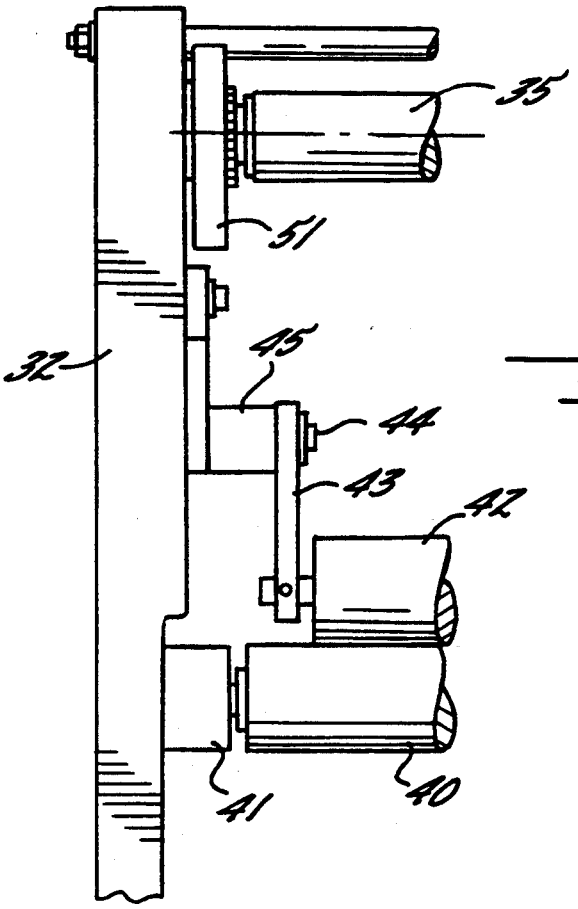
FIG. 5 is a view similar to FIG. 4 of the opposite end of the take-up mechanism as shown in FIG. 4.

In this embodiment, drive roll 42 is also driven in rotation by an identical motor 66 and reduction gearing (not shown) to motor 60 and reduction gearing 61 which drives delivery roll 35. Motor 66 is mounted within the hollow drive roll 42 (FIG. 4).

In accordance with the present invention, the fabric 27 will pass downwardly through the cylinder 26 to the delivery rolls 36 and 37 where the same is flattened and passes through the nip between delivery rolls 36 and 37 and then through the nip between delivery rolls 35 and 36 downwardly around the periphery of drive roll 42 and between the nip between take-up roll 40 and drive roll 42 to be wound about take-up roll 40. If the tension of fabric 27 increases above a predetermined desired amount, the swing arms 51 will pivot in a counter clockwise direction as seen in FIG. 2, with the free outer ends thereof moving upwardly.

A proximity sensing device 70 is mounted by a bracket 71 beneath the outer free end of one of the swing arms 51. The proximity sensor 70 senses the pivotal movement of the swing arm 51 from its normal operating position and also senses the distance that the free end of the swing arm 51 has moved from its normal position. Bracket 71 is mounted at its other end on a block 72 which, in turn, is mounted on one of the side frame members 32. A leaf spring 73 is carried by the top of block 72 and is positioned beneath the outer free end of swing arms 51 to bias swing arm 51 toward its normal operating position while permitting some limited downward movement of the free ends of swing arms 51 upon a reduction in the tension in fabric 27 from the normal desired tension therein. Upon such limited downward movement, the proximity sensor 70 will sense the shorting of the distance between the free end of swing arm 51 and proximity sensor 70 which is indicative of a decrease in the tension in fabric 27.

In lieu of the proximity sensor 70, a load cell 74 may be interposed between the free end of swing arm 51 and the side frame member 32. Load cell 74 normally is loaded a predetermined amount by the swing arm 51 when the swing arm is in its normal operating position maintaining the predetermined desired tension in the fabric 27. When the tension in fabric 27 increases, the swing arms 51 will pivot upwardly about the delivery roll 35 and the predetermined initial loading of load cell 74 will be reduced by a decreasing amount corresponding to the increase in the amount of tension in fabric 27. Similarly, as tension in fabric 27 decreases, the load on load cell 74 will be increased by an amount concomitant with the decrease in tension in fabric 27.

Figure 7:
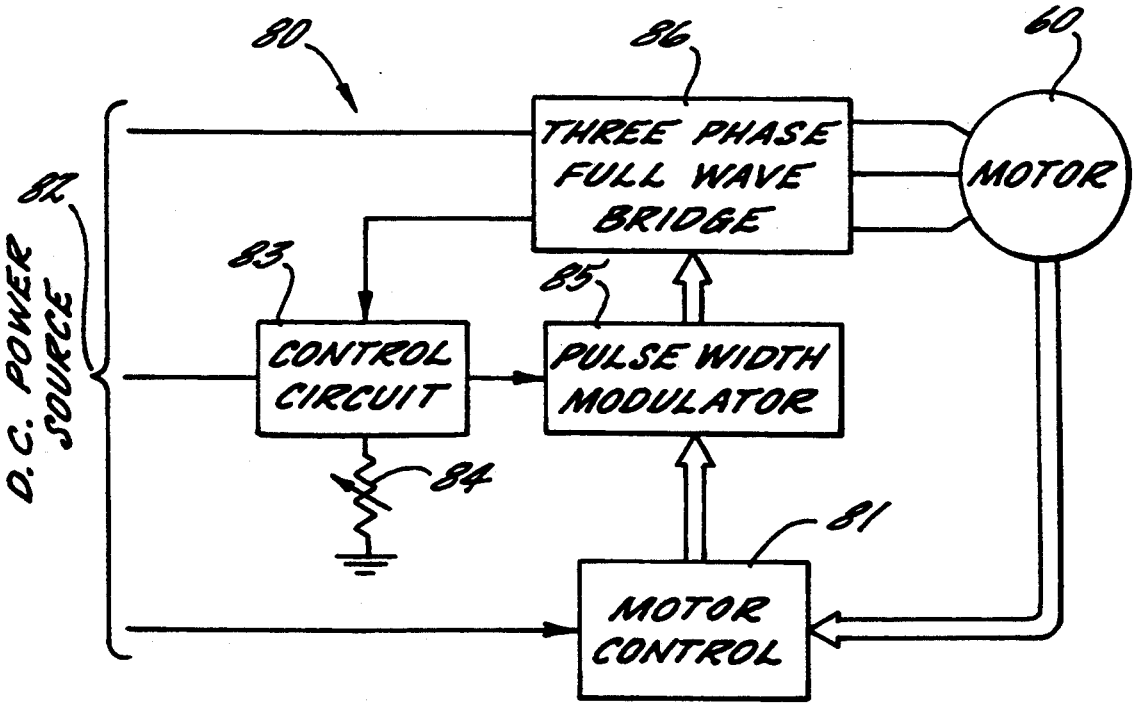
FIG. 7 is a circuit diagram illustrating the control circuit for the take-up mechanism of the present invention.

Both proximity sensor 70 and load cell 74 generate electrical signals indicative of increases or decreases in the tension in fabric 27. Control means, generally indicated at 80 in FIG. 7, is provided for controlling the speed of motor 60 driving delivery rolls 35, 36 and 37 in accordance with the signals generated by the tension sensing means, i.e. proximity sensor 70 or load cell 74, of the present invention. The control means 80 includes a motor control 81 which is connected to a suitable power source 82, such as a DC power source. Motor control 81 is connected to motor 60 and receives a feedback signal from motor 60 concerning the state of operation of motor 60 at any given time.

Control means 80 further includes a control circuit 83 which is connected, in a manner not shown, to the proximity sensor 70 or load cell 74 for receiving signals from these fabric tension sensing means. Control circuit 83 includes a potentiometer or variable resistor 84, whereby control circuit 83 may be preset for a predetermined normal or desired fabric tension. The control circuit 83 compares the signal from the fabric tension sensing means with the preset reference value set by potentiometer 84 and any deviation from this preset reference value is fed to a pulse width modulator controller 85. PWM controller 85 is also connected to the motor control 81 for receiving feedback signals from motor 60. PWM controller 85 compares the deviation signal from control circuit 83 with the feedback signal from motor control 81 and generates a power signal to motor 60 through a three phase full wave bridge 86, the output side of which is connected to motor 60. This power signal determines the speed at which motor 60 will drive the delivery roll 35 and delivery rolls 36 and 37.

If the signal from the fabric tension sensing means 70 or 74 indicates a decrease in fabric tension from the reference value initially set, the control means 80 will cause motor 60 to drive delivery roll 35, 36 and 37 faster until the fabric tension equals the initially set, reference value. Once the feedback signal from the fabric tension sensing means is equal to the reference value then no deviation signal will be sent to the PWM controller 85 and the motor 60 will operate at a constant speed. If the signal from the fabric tension sensing means 70 or 74 indicates an increase in tension above the initially set reference value, the control means 80 will cause the motor 60 to drive the delivery rolls at a slower speed until the tension in the fabric is reduced to the reference value.

Motor 66 drives the drive roller 42 at a uniform torque. Accordingly, the fabric 27 is wound up on the take-up roll 40 at the uniform fabric tension at which the fabric 27 is delivered from the delivery rollers 35, 36 and 37.

Figure 6:
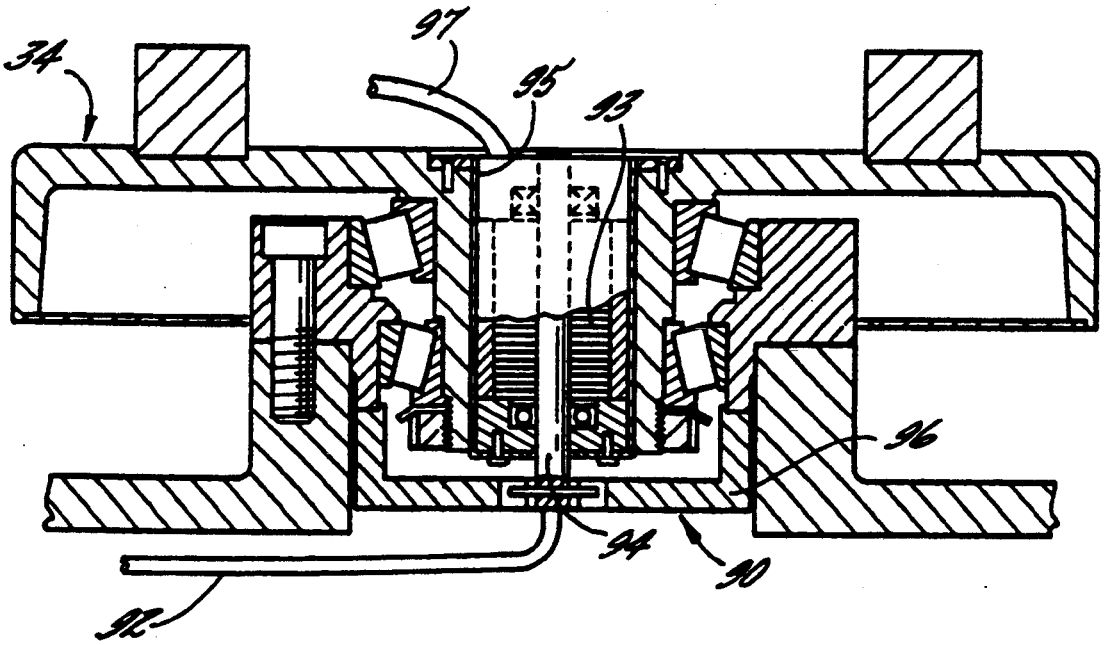
FIG. 6 is a fragmentary enlarged sectional view taken substantially along line 6—6 in FIG. 1.

Referring now to FIG. 6, there is shown a power transfer device generally indicated at 90 by which power is supplied to the motors 60 and 66 and to the proximity sensor 70 or load cell 74. Power transmitting device 90 is housed in bearing box 34 that mounts to the lower portion of the take-up mechanism 30 for rotation. Power transfer device 90 includes an input line 92 which is connected to a contact ring 93 rotating on a shaft 94 in contact with a carbon brush 95. The vertical shaft 94 is mounted in a hollow box 96 which, in turn, is mounted on the lower portion of bearing box 34. The carbon brush 95 is mounted on the cover portion of bearing box 34 for rotation therewith as the take-up mechanism 30 rotates with the cylinder 26. An output lead 97 is connected at one end to the carbon brush 95 and at its other end to motors 60 and 66 and to the fabric tension sensing means, such as proximity sensor 70 or load cell 74.

Figure 8:
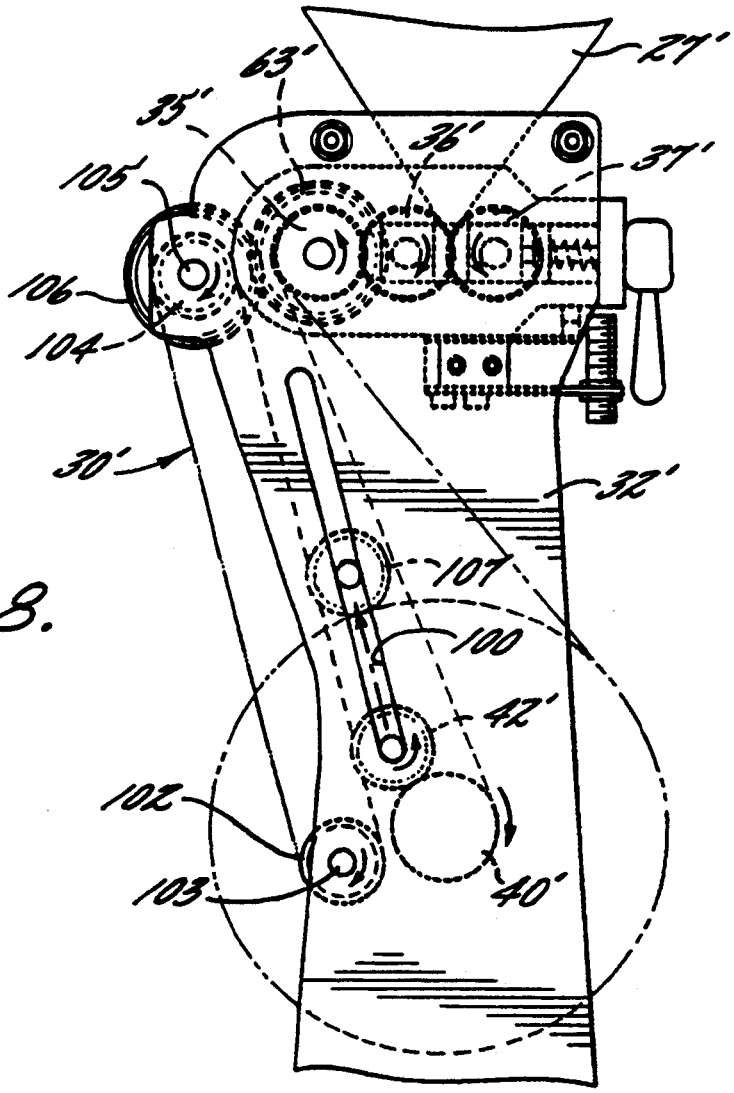
FIG. 8 is a view similar to FIG. 2 of another embodiment of the take-up mechanism of the present invention.

Referring now to FIG. 8, there is illustrated another embodiment of the drive roll and drive means therefor and in which like parts are referred to by the same reference characters with the prime notation added. A fabric take-up mechanism 30′ includes side frame members 32′ mounting delivery rolls 35′, 36′ and 37′ and a fabric take-up roll 40′. The delivery rolls 35′, 36′ and 37′ are mounted and are driven in the same manner as were delivery rolls 35, 36 and 37 in the embodiment illustrated in FIGS. 1 through 3.

A drive roll 42′ is journaled for rotation in slots 100 formed in the side frame members 32′ for sliding vertical movement along the slots 100 as the fabric roll being formed around take-up roll 40′ increases in diameter. Drive roll 42′ is driven by a chain 101 which is trained about an idler sprocket 102 at its lower end. Idler sprocket 102 is mounted for rotation on a shaft 103 which is journaled within suitable bearings mounted on the side frame member 32′. Drive chain 101 is trained at its upper end about a drive sprocket 104 mounted on a shaft 105 also journaled for rotation in bearings mounted on side frame member 32′. Shaft 105 has a spur gear 106 drivingly mounted thereon which meshes with the spur gear 63′ mounted for rotation on delivery roll 35′. Spur gear 63′ drives spur gear 106 and thereby drives sprocket 104 and chain 101. A sprocket 107 is mounted on drive roll 42′ and rotates drive roll 42′ in timed relation to the rotation of delivery roll 35′. It is noted that slots 100 are parallel to the drive chain 101 such that the sprocket 107 on drive roll 42′ remains in contact with the drive chain 101 as drive roll 42′ moves along slots 100. The speed at which the drive roll 42′ is driven is such that drive roll 42′ rotates slightly faster than the delivery rolls 35′, 36′ and 37′, taking into consideration the reduction of the tension in the fabric that is forcefully delivered by the delivery rolls 35′, 36′ and 37′.

Figure 15:
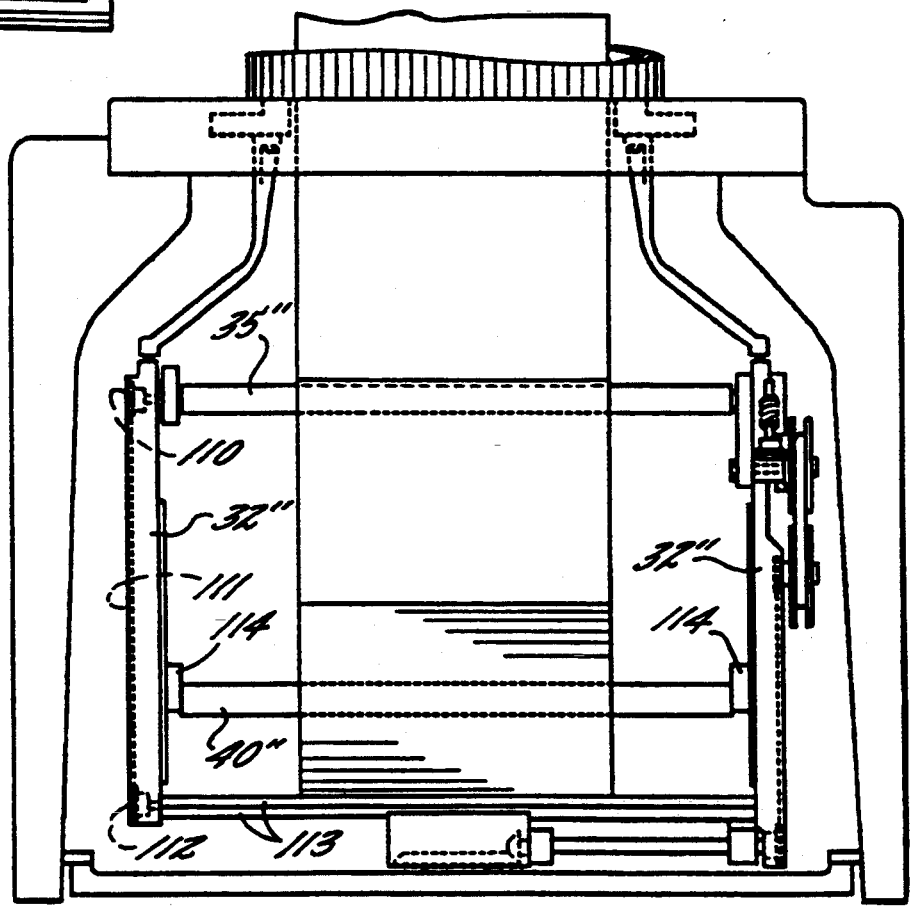
Fig. 15. (PRIOR ART)
FIG. 15 is a front elevational view of a circular knitting machine illustrating a prior art take-up mechanism.

In lieu of the foregoing drive for the take-up roll 40, the drive mechanism shown in FIG. 15 and disclosed more particularly in U.S. Pat. No. 4,671,083 may be utilized. In this arrangement, a sprocket 110 is mounted on the end of the shaft of delivery roll 35″ and drives a sprocket chain 111 which is trained at its lower end about a driven sprocket 112 on the shaft of one of a pair of friction drive rolls 113 (only one of which is shown in FIG. 15). The disclosure of U.S. Pat. No. 4,671,083 is incorporated herein by reference. Take-up roll 40″ is journaled at its opposite ends in square bearings 114 which are slidably mounted in vertical slots formed in or on the side frame members 32″.

Figure 9:
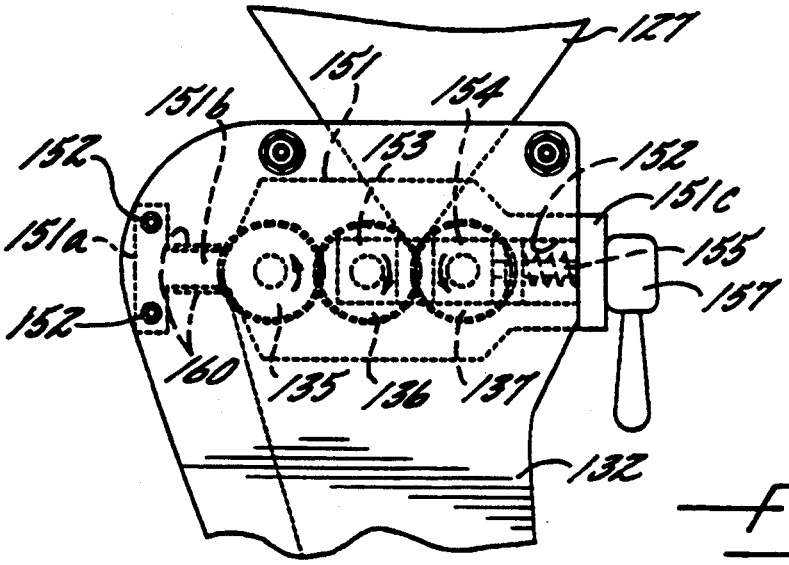
FIG. 9 is a view similar to FIG. 8 of another embodiment of the tension sensing means of the present invention.
Figure 10:
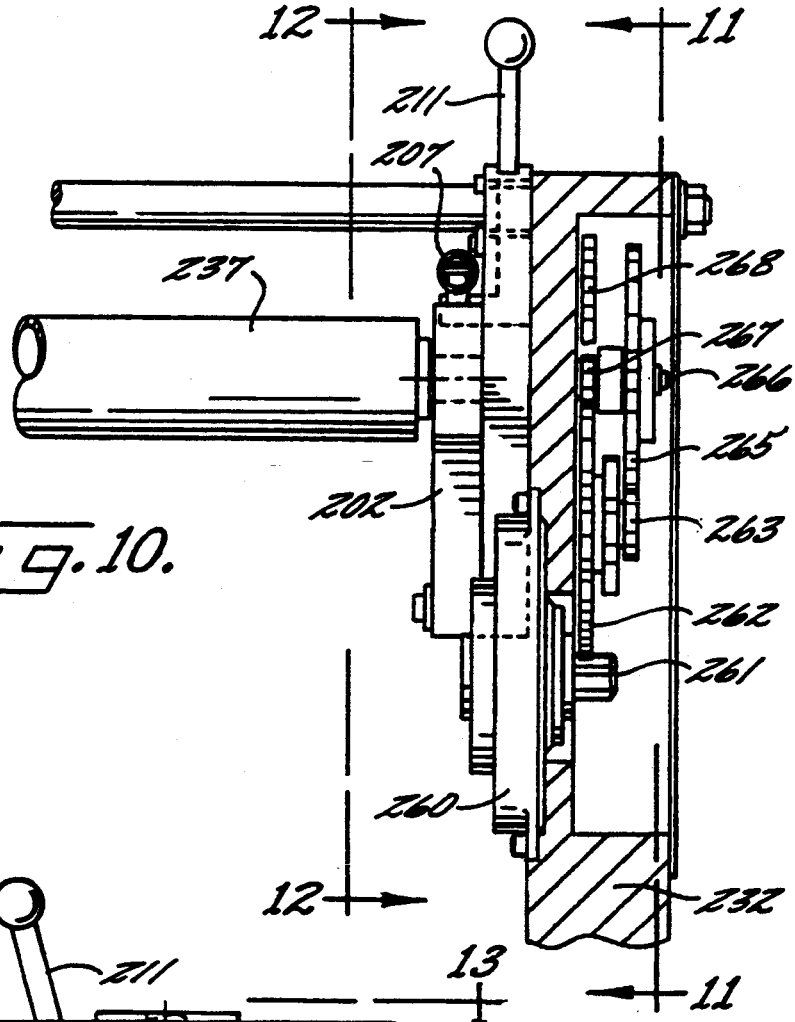
FIG. 10 is a fragmentary enlarged sectional view similar to FIG. 2 of another embodiment of the drive means for the delivery rolls.
Figure 11:
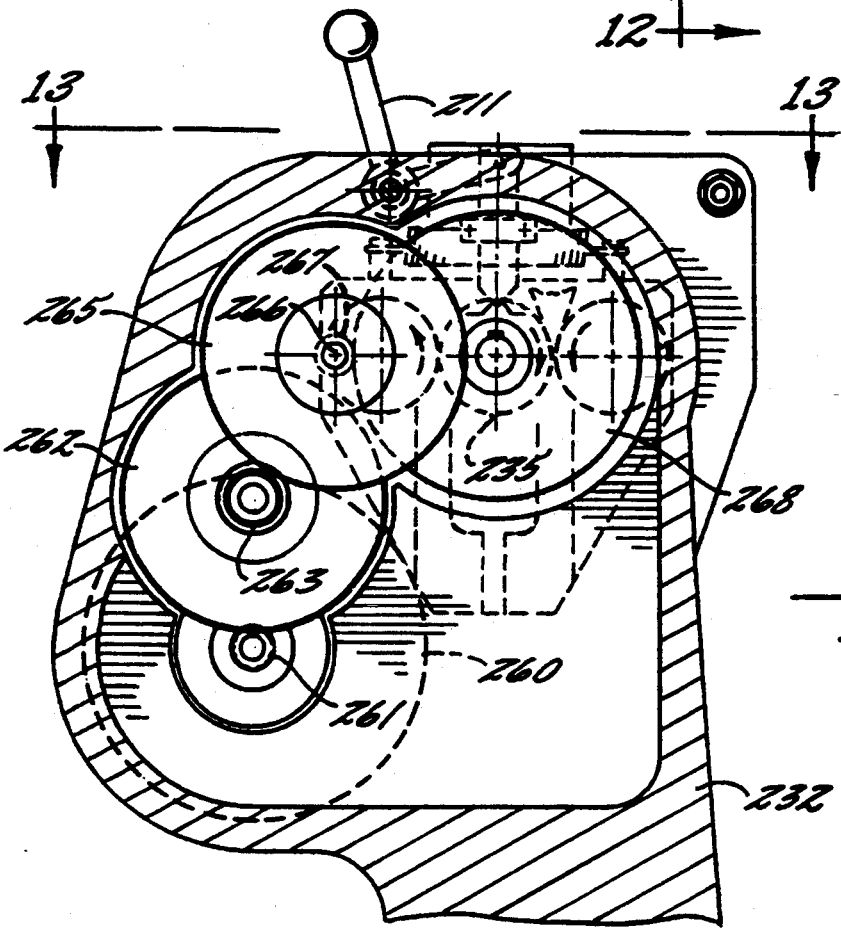
FIG. 11 is a fragmentary sectional view taken substantially along 11—11 in FIG. 10.
Figure 12:
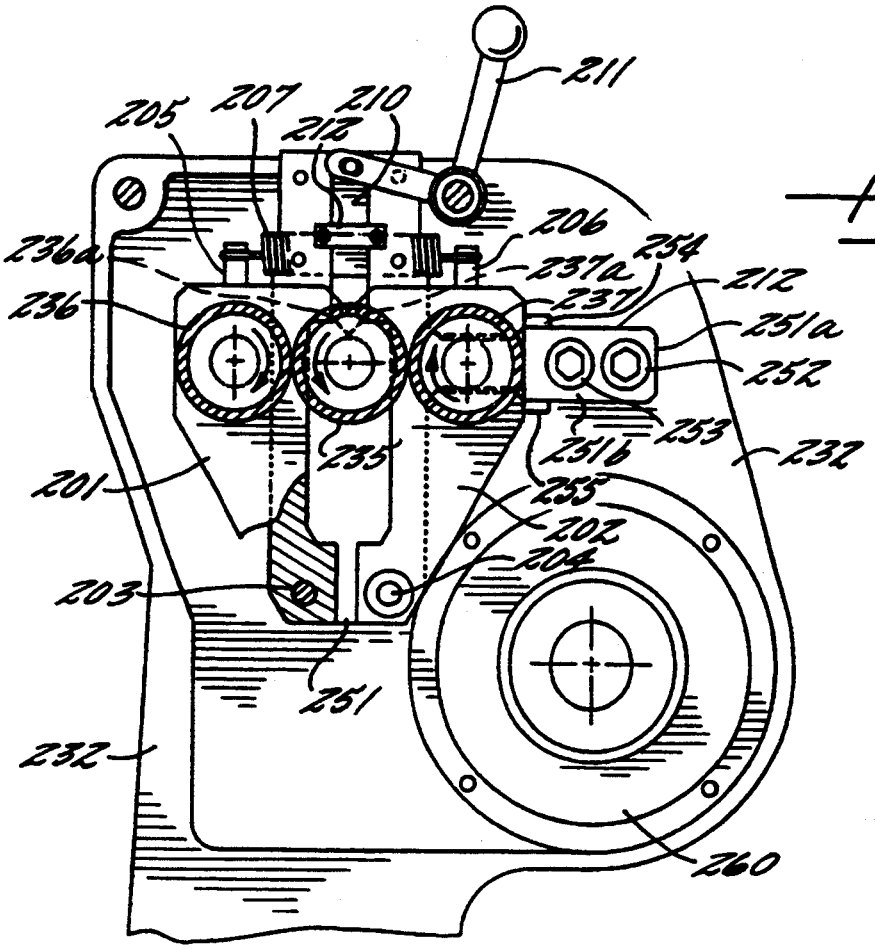
FIG. 12 is a fragmentary sectional view taken substantially along 12—12 in FIG. 10.
Figure 13:
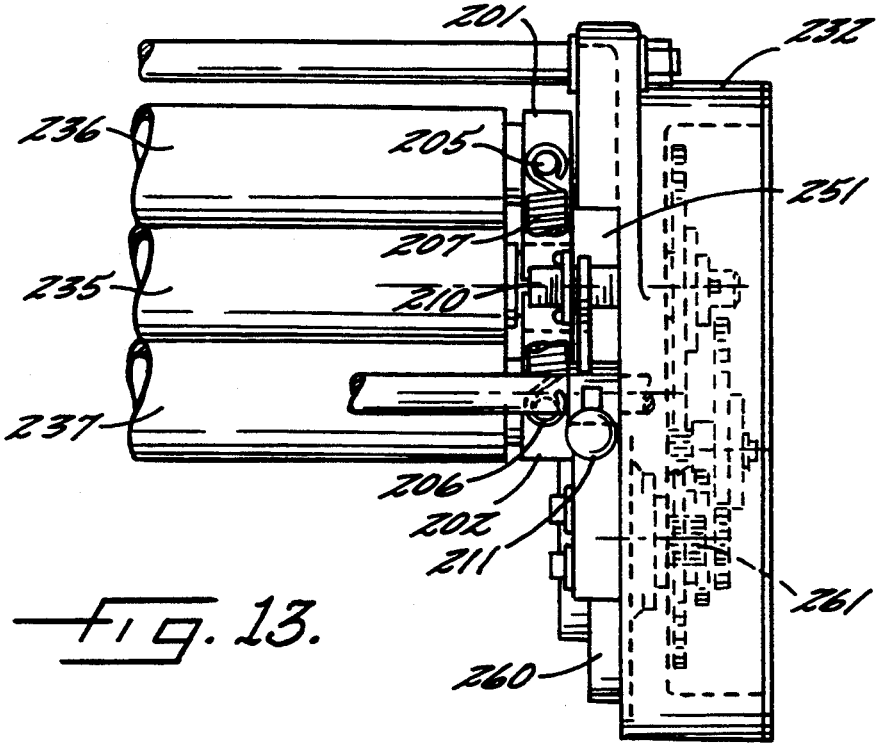
FIG. 13 is a top plan view looking in the direction of the arrows 13 in FIG. 11.

Referring now to FIG. 9, there is shown still another embodiment of a tension sensing means in accordance with the present invention. In this arrangement, delivery rolls 135, 136 and 137 are in a generally horizontal arrangement. Roll 135 is journaled for rotation at its opposite ends on a pair of swing arms 151. Swing arms 151 are fixedly mounted at one end 151*a* thereof by bolts 152 on the side frame members 132. Swing arms 151 have a reduced neck portion 151*b* which has sufficient flexibility therein to permit some upward and downward flexure movement of the free end portions 151*c* of swing arms 151 upon fluctuations in the tension in the fabric 127. Rolls 136 and 137 are journaled at their opposite ends in square bearings 153, 154 mounted in slots 152 in the swing arms 151. A coil spring 155 presses the rolls 136 and 137 together and roll 136 against roll 135, while a roll separating means 157 is provided for separating the rolls as desired.

A pair of strain gauges 160 are mounted on top and bottom sides of the neck portions 151*b* of the swing arms 151 for compression upon vertical movement of the free ends 151*c* thereof and flexure of the necks 151*b*. The deformation of the strain gauges 160 is converted to an electrical signal which is then fed to the control circuit 83 of the control means 80 illustrated in FIG. 7.

Referring now to FIGS. 10 through 14, there is illustrated a still further embodiment of the mounting means for the delivery rolls and a drive means therefor. In this embodiment, the stationary delivery roll 235 is mounted in the center of the three delivery roll arrangement with the movable delivery rolls 236 and 237 mounted on opposite sides thereof. The delivery roll 235 is journaled for rotation at its opposite ends on swing arms 251 fixedly mounted on side frame members 232 by bolts 252, 253 at one end 251*a* thereof. Swing arms 251 have neck portions 251*b* which flex upon fluctuations in tension of the fabric.

Delivery rolls 236 and 237 are journaled for rotation at their opposite ends on pivotal mounting members 201, 202 which are pivotally mounted at their lower ends on swing arms 251 by pivot pins 203, 204. Pivotal mounting members 201 and 202 have upstanding studs 205, 206 at their free upper ends which are connected by a tension spring 207 to bias delivery rolls 236 and 237 against the center delivery roll 235.

Pivotal mounting members 201 and 202 have cam portions 236*a* and 237*a* that are contiguous to each other above center mounted delivery roll 235. Cam members 210 are mounted for vertical movement on swing arms 251 by slide blocks 212 and have operating levers 211 connected thereto for manual vertical movement of the cam members 210 upwardly and downwardly between slide blocks 212 and swing arms 251 for contact with the cam portions 236*a* and 237*a* to move the pivotal mounting members 201 and 202 away from each other and to thereby move the delivery rolls 236 and 237 away from the center mounted delivery roll 235.

Strain gauges 254, 255 are mounted on opposite sides of the neck portion 251*b* of swing arms 251 for sensing variations in the tension of the fabric. These strain gauges 254, 255 function as described in connection with the embodiment shown in FIG. 9.

The drive means for the delivery rolls 235, 236 and 237 includes a variable speed motor 260 suitably mounted on a side frame member 232. Motor 260 drives a reduction gearing including a drive gear 261 on the output shaft thereof. Drive gear 261 meshes with a suitable spur gear 262 mounted for rotation on a stub shaft 263 journaled for rotation in suitable bearings (not shown) mounted on side frame member 232. Stub shaft 263 also includes a smaller spur gear 264 thereon which meshes with a larger diameter spur gear 265 mounted for rotation on a stub shaft 266 journaled for rotation in bearings carried by the side frame member 232. Stub shaft 266 has mounted thereon a smaller diameter drive gear 267 which meshes with a spur gear 268 mounted on the shaft of the delivery roll 235.

Figure 14:
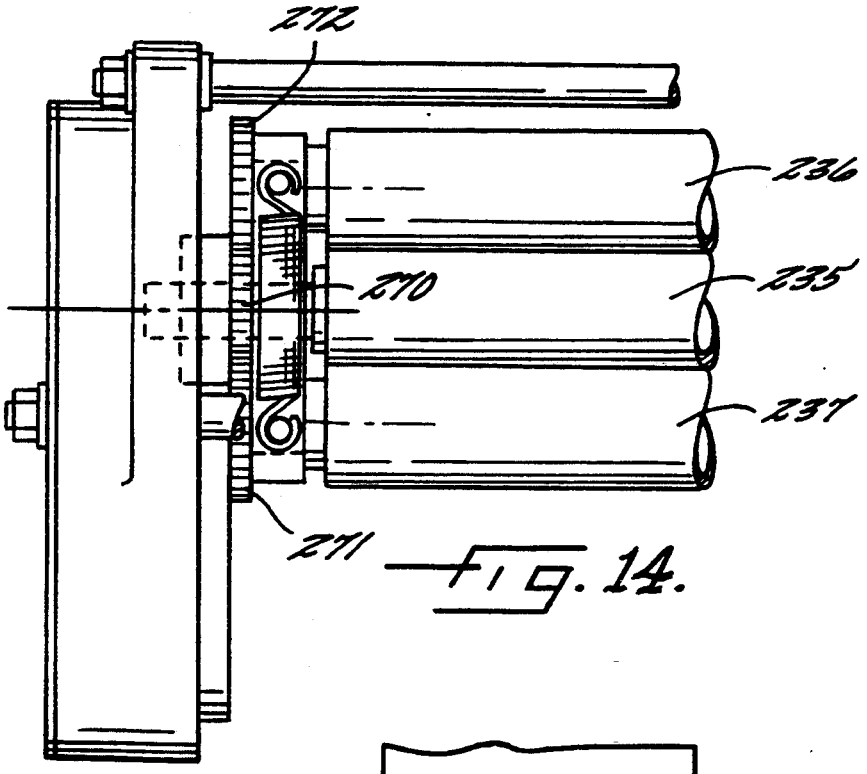
FIG. 14 is a view similar to FIG. 13 of the opposite end of the take-up mechanism shown in FIG. 13.

In FIG. 14, there is illustrated the opposite ends of the delivery rolls 235, 236 and 237. The shaft of delivery roll 235 has a spur gear 270 mounted thereon for rotation therewith which meshes with a spur gear 271 mounted on the shaft of delivery roll 236 and a spur gear 272 mounted on the shaft of delivery roll 237. Delivery rolls 236 and 237 are thereby driven in synchronism with the delivery roll 235.

The motor 260 is controlled by a control circuit as illustrated in FIG. 7 and is responsive to the tension sensing means for controlling the speed at which motor 260 drives the delivery rolls 235, 236 and 237. Any of the drive mechanisms for the take-up roll may be used with the embodiment of delivery rolls illustrated in FIGS. 10 through 14.

In the drawings and specifications, there have been set forth preferred embodiments of the invention, and although specific terms are employed, they are used in generic and descriptive sense only and not for purpose of limitation.

That which is claimed is:

1. In a circular knitting machine including a needle cylinder and knitting instrumentalities for forming a tubular knit fabric and a fabric take-up mechanism for flattening the fabric and winding the flattened fabric into a roll, said take-up mechanism including fabric delivery rolls mounted beneath said needle cylinder and frictionally gripping the fabric formed in the needle cylinder for flattening and feeding the fabric downwardly from the needle cylinder and a fabric take-up means beneath said fabric delivery rolls for winding the flattened fabric delivered by said fabric delivery rolls into a roll, the combination therewith of sensing means for sensing the tension in the fabric between the needle cylinder and said fabric take-up means, said sensing means comprising a pair of swing arms mounting at least some of said delivery rolls for movement responsive to fluctuations in the tension in the fabric, said swing arms being fixedly mounted at one end thereof and having at least a portion thereof sufficiently flexible to permit limited movement of the other ends of the swing arms, said sensing means further comprising means carried by the flexible portion of each swing arm and responsive to flexure thereof for generating a signal indicative of the amount of flexure caused by the change in tension in the fabric, drive means for driving said fabric delivery rolls, said drive means including a variable speed drive motor, and control means operatively connected to said sensing means and said variable speed motor for varying the rotational speed of said fabric delivery rolls responsive to signals from said sensing means upon variations in tension in the fabric to maintain a substantially uniform tension in the fabric.

2. A circular knitting machine according to claim 1 wherein said variable speed motor comprises an outrotor motor mounted within one of said delivery rolls.

3. A circular knitting machine according to claim 1 wherein said signal generating means comprises strain gauge means mounted on the flexible portions of said swing arms.

4. A circular knitting machine according to claim 1 wherein said variable speed motor is connected to said delivery rolls by gear reduction means.

5. A fabric take-up apparatus for a circular knitting machine comprising (a) a plurality of delivery rolls adapted to be mounted beneath a needle cylinder of the circular knitting machine for flattening and delivering fabric formed by the circular knitting machine, (b) fabric take-up means mounted below said delivery rolls for receiving the fabric from said delivery rolls and winding the fabric into a roll, (c) tension sensing means for sensing fluctuation in the tension in the fabric and for generating electrical signals indicative of such fluctuations in tension, said tension sensing means comprising a pair of swing arms mounting at least some of said delivery rolls for movement responsive to fluctuations in the tension in the fabric, said swing arms being fixedly mounted at one end thereof and having at least a portion thereof sufficiently flexible to permit limited movement of the other ends of the swing arms, said sensing means further comprising means carried by the flexible portion of each swing arm and responsive to flexure thereof for generating a signal indicative of the amount of flexure caused by the change in tension in the fabric, (d) variable speed drive means for driving said delivery rolls, and (e) control means connected to said tension sensing means for receiving said electrical signals from said tension sensing means and connected to said variable speed drive means for controlling said drive means responsive to said electrical signals to vary the speed of said delivery rolls responsive to the sensed fluctuations in the tension in the fabric, whereby a substantially uniform tension is maintained in the fabric.

6. A fabric take-up apparatus according to claim 5 wherein said variable speed drive means comprises a variable speed motor.

7. A fabric take-up apparatus according to claim 5 wherein said delivery roll mounting means mounts all of said delivery rolls for movement responsive to fluctuations in the tension in the fabric.

8. A fabric take-up apparatus according to claim 5 wherein said signal generating means comprises strain gauges mounted on the flexible portions of said swing arms for sensing the direction and extent of movement of said swing arms and for generating electrical signals indicative of the direction and extent of such movement and thereby indicative of fluctuations in tension in the fabric.

9. A fabric take-up apparatus according to claim 5 wherein said control means includes means adjustable to preset a reference value corresponding to the desired tension to be maintained in the fabric, comparative means for comparing the electrical signals received from said tension sensing means with said preset reference value and generating a control signal indicative of any deviation of the signals from said tension sensing means from said reference value, and means for controlling said variable speed drive responsive to said control signal.

* * * * *